US011688570B2

(12) United States Patent
Lantz et al.

(10) Patent No.: US 11,688,570 B2
(45) Date of Patent: Jun. 27, 2023

(54) SWITCHING DEVICE

(71) Applicant: ABB Schweiz AG, Baden (CH)

(72) Inventors: Gabriel Lantz, Zurich (CH); Matthias Bator, Klettgau (DE); Markus Abplanalp, Baden-Dättwil (CH); Ralf-Patrick Suetterlin, Baden (CH)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 17/187,923

(22) Filed: Mar. 1, 2021

(65) Prior Publication Data

US 2021/0327663 A1 Oct. 21, 2021

(30) Foreign Application Priority Data

Feb. 27, 2020 (EP) ..... 20159685

(51) Int. Cl.
*H01H 33/04* (2006.01)
*H01H 33/42* (2006.01)

(52) U.S. Cl.
CPC ..... *H01H 33/04* (2013.01); *H01H 33/42* (2013.01)

(58) Field of Classification Search
CPC ..... H01H 1/2058; H01H 1/58; H01H 1/5833; H01H 9/32; H01H 33/04; H01H 33/42; H01H 73/045; H01H 73/18; H01H 33/06; H01H 33/46
USPC ..... 218/146, 77, 41; 200/50.22, 304
See application file for complete search history.

(56) References Cited

U.S. PATENT DOCUMENTS 4,801,772 A * 1/1989 Bratkowski ..... H01H 77/10 218/117
4,880,948 A * 11/1989 Kandatsu ..... H01H 9/32 337/91
6,084,193 A * 7/2000 Pellon ..... H01H 9/32 218/117
6,437,960 B1 * 8/2002 Chen ..... H01H 9/32 361/103
8,686,311 B2 * 4/2014 Vigouroux ..... H01H 9/32 218/147

(Continued)

FOREIGN PATENT DOCUMENTS

CN 103531379 A 1/2014
CN 209658042 U 11/2019

(Continued)

OTHER PUBLICATIONS

European Patent Office, Extended Search Report issued in corresponding Application No. 20159685,5, dated Jul. 31, 2020, 9 pp.

*Primary Examiner* — William A Bolton
(74) *Attorney, Agent, or Firm* — Armstrong Teasdale LLP

(57) ABSTRACT

A switching device for low-voltage or medium-voltage applications including: one or more electric poles; for each electric pole, at least a fixed contact and at least a movable contact, each movable contact being reversibly movable between a coupled position, at which the movable contact is coupled with a corresponding fixed contact, and an uncoupled position, at which the movable contact is separated from the fixed contact, wherein a separation gap is present between the movable contact and the fixed contact, when the movable contact is in the uncoupled position. The switching device includes, for each electric pole, at least an arc-diverting element made of electrically insulating material.

20 Claims, 10 Drawing Sheets

(56) References Cited

U.S. PATENT DOCUMENTS

| | | | | |
|---|---|---|---|---|
| 2008/0186126 | A1* | 8/2008 | Ying | H02J 13/00022 337/333 |
| 2014/0048512 | A1* | 2/2014 | Nakafuji | C08G 8/20 524/611 |
| 2019/0348236 | A1* | 11/2019 | Oh | H01H 73/045 |
| 2020/0227220 | A1* | 7/2020 | Oehler | H01H 33/46 |

FOREIGN PATENT DOCUMENTS

| | | | |
|---|---|---|---|
| DE | 29516057 | U1 | 12/1995 |
| DE | 102015202221 | A1 | 8/2016 |
| EP | 3567620 | A1 | 11/2019 |
| JP | 2005235670 | A | 9/2005 |
| WO | 2019121986 | A1 | 6/2019 |

* cited by examiner

SWITCHING DEVICE

BACKGROUND

The present invention relates to a switching device, such as a circuit breaker, a disconnector, a contactor or the like, to be used preferably in low-voltage or medium-voltage electric systems. Switching devices, such as for example circuit breakers, disconnectors, contactors, limiters, and the like, generally comprise a casing and one or more electrical poles, associated to each of which there is at least one pair of contacts (normally including a fixed contact and a movable contact) that can be mutually coupled or uncoupled.

As is known, during an opening operation of the switching device, electric arcs may rise between the movable contact and the fixed contact as soon as the movable contact separates from the fixed contact.

In fault protection operations, when an opening operation of the switching device is carried out with the aim of interrupting high currents (e.g. overload currents or short-circuit currents), possible electric arcs are normally diverted away from the electric contacts by strong electromagnetic forces by the circulating current. Electric arcs may thus reach suitable arc-quenching arrangements designed to favor their quenching in such a way to complete the current interruption process. In absence of fault conditions, if the interrupted currents have intensity around the nominal value, possible electric arcs rising in the contact region during an opening operation generally extinguish in a relatively short time, as electromagnetic forces are still sufficiently strong to divert said electric arcs towards the above-mentioned arc-quenching arrangements.

However, when the interrupted currents have values lower than the nominal value, in particular the so-called "critical values" (e.g. between the 5% and the 30% of the nominal value), the electromagnetic forces generated during an opening operation may not be strong enough to divert possible electric arcs between the electric contacts. Electric arcs may thus remain located at the separation gap between said electric contacts.

In AC switching devices, this phenomenon obliges to wait for a natural current zero instant in order to complete the current interruption process.

In DC switching devices, however, there may be even more critical consequences.

Electric arcs between the electric contacts may last for a very long time, which may lead to a quick degradation of the electric contacts and even to a failure of the current interruption process by the switching device.

SUMMARY

Based on the above considerations, the main aim of the present invention is to provide a switching device for low-voltage or medium-voltage electric systems, which allows mitigating or overcoming the above-mentioned shortcomings.

Within this aim, an object of the present invention is to provide a switching device, in which possible electric arcs between the electric contacts of the electric poles may be easily extinguished, even if relatively low currents are interrupted.

A further object to the present invention is to provide a switching device, which is particularly adapted to interrupt DC currents or AC currents.

A further object to the present invention is to provide a switching device, which can reliably operate and can be manufactured in a relatively easy way, at competitive costs with similar switching devices of the state of the art.

The above-mentioned aims and objects are achieved by a switching device for low-voltage or medium-voltage electric systems, according to the following claim 1 and related claims.

In a general definition, the switching device, according to the invention comprises:

one or more electric poles;

for each electric pole, at least a fixed contact and at least a movable contact. Each movable contact is reversibly movable between a coupled position, at which said movable contact is coupled with a corresponding fixed contact, and an uncoupled position, at which said movable contact is separated from said fixed contact. A separation gap is present between said movable contact and said fixed contact, when said movable contact is in said uncoupled position.

According to some embodiments of the invention, said movable contact reversibly moves between said coupled position and said uncoupled position with opposite rotational movements.

According to other embodiments of the invention, said movable contact reversibly moves between said coupled position and said uncoupled position with opposite linear movements.

According to the invention, the switching device comprises, for each electric pole, at least an arc-diverting element made of electrically insulating material, preferably a degassing material.

Each arc-diverting element of the switching device can switch between an inactive position, at which said arc-diverting element is not interposed between a corresponding movable contact and a corresponding fixed contact, and an active position, in which at least a portion of said arc-diverting element is interposed between said movable contact and said fixed contact at the separation gap between said movable contact and said fixed contact.

According to the invention, each arc-diverting element can switch from said inactive position to said active position upon a movement of said movable contact from said coupled position to said uncoupled position.

According to the invention, the arc-diverting element switches from said active position to said inactive position upon a movement of said movable contact from said uncoupled position to said coupled position.

Preferably, the movement of said arc-diverting element between said active position and said inactive position is caused by a movement of the movable contact itself or it is caused by a mechanism operatively coupled with said movable contact.

According to an important aspect of the invention, said arc-diverting element moves from said inactive position to said active position, in which it reaches the separation gap, with a time delay with respect to the movement of said movable contact, in particular with respect to instant in which said movable contact uncouples from said fixed contact, during an opening operation of said switching device.

Preferably, said minimum time delay is higher than 1 ms.

According to some embodiments of the invention, the switching device comprises, for each electric pole, at least a lamina of electrically insulating material.

Said lamina comprises a fixing portion fixed to a supporting surface and a flexible portion forming an arc-diverting element.

Said flexible portion is movable between an inactive position, at which it is not bent with respect to said fixing portion and it is not interposed between said movable contact and said fixed contact, and an active position, in which it is bent with respect to said fixing portion and it is interposed between said movable contact and said fixed contact at the separation gap between said movable contact and said fixed contact.

According to other embodiments of the invention, the switching device comprises, for each electric pole, at least a shaped plunger of electrically insulating material forming an arc-diverting element and elastic means operatively coupling said plunger to a fixed support.

Each plunger is reversibly movable between an inactive position, at which it is not interposed between said movable contact and said fixed contact, and an active position, in which it is interposed between said movable contact and said fixed contact at the separation gap between said movable contact and said fixed contact.

According to other embodiments of the invention, the switching device comprises, for each electric pole, at least a shaped plunger of electrically insulating material forming an arc-diverting element and a motion transmission mechanism operatively coupled to said plunger and to said movable contact.

Each plunger is reversibly movable between an inactive position, at which it is not interposed between said movable contact and said fixed contact, and an active position, in which it is interposed between said movable contact and said fixed contact at the separation gap between said movable contact and said fixed contact.

Preferably, the switching device, according to the invention, is adapted for installation in DC or AC electric systems, such DC or AC electric power distribution grids.

BRIEF DESCRIPTION OF THE FIGURES

Further features and advantages of the present invention will be more apparent from the description of preferred but not exclusive embodiments of the arc chamber for a low-voltage switching device of the present invention, shown by way of examples in the accompanying drawings, wherein.

DETAILED DESCRIPTION

With reference to the attached figures, the present invention relates to a switching device for low-voltage or medium-voltage electric systems.

For the purposes of the present invention, the term "low voltage" (LV) relates to operating voltages lower than 1 kV AC and 1.5 kV DC whereas the term "medium voltage" (MV) relates to operating voltages higher than 1 kV up to some tens of kV, e.g. 70 kV AC and 100 kV DC.

Figure 1:
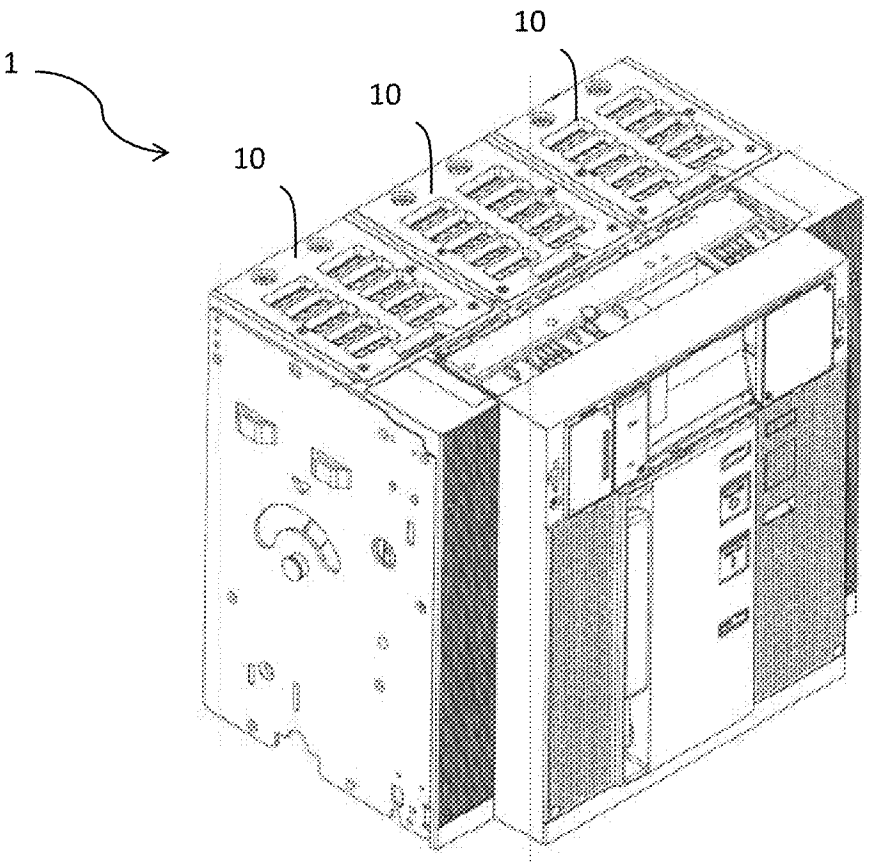
FIG. 1 is a perspective view of a switching device, according to the present invention, which is particularly suitable for use in low-voltage electric systems.

FIG. 1 shows a possible embodiment of the switching device 1. In this case, the switching device 1 is a circuit breaker designed for low-voltage electric systems.

In principle, however, the switching device 1 may be of different type, such as a disconnector, a contactor or the like.

The switching device 1 may be adapted to allow or interrupt the flow of DC or AC currents in low-voltage or medium-voltage electric systems.

The switching device 1, however, is particularly adapted for installation in a DC electric system and, for the sake of simplicity, it will be described in the following with particular reference to this application without intending to limit the scope of the invention in any way.

According to the invention, the switching device 1 comprises one or more electric poles 10. Each electric pole 10 can be electrically coupled with corresponding conductors of an electric line, for example with a conductor electrically connecting said electric pole with an electric power source and a conductor electrically connecting said electric pole with an electric load.

According to the invention, the switching device 1 comprises, for each electric pole 10, at least a pair of electric contacts 20 and 30 that can be mutually coupled or decoupled in order to allow or interrupt the flow of a current through said electric pole.

In particular, the switching device 1 comprises, for each electric pole 10, at least a fixed contact 20 and at least a movable contact 30 that can be mutually coupled or decoupled.

According to some embodiments of the invention (FIGS. 5A-5B, 6A-6D, 7A-7A), the switching device 1 comprises, for each electric pole 10, a single fixed contact 20 and a single movable contact 30 that can be mutually coupled or decoupled (single breaking configuration).

According to other embodiments of the invention (FIGS. 4A-4D), the switching device 1 comprises, for each electric pole 10, a pair of fixed contacts 20 and a pair of movable contacts 30 that can be mutually coupled or decoupled (double breaking configuration).

Obviously, other solutions are possible, according to the needs.

According to the invention, each movable contact 30 is reversibly movable between a coupled position C, at which it is coupled with a corresponding fixed contact 20, and an uncoupled position O, at which it is separated from the corresponding fixed contact 20.

When the switching device 1 carries out an opening operation, each movable contact 30 moves from the coupled position C to the uncoupled position O. Such a operation of the switching device is directed to interrupt currents flowing along the electric poles 10.

Conveniently, a separation gap 40 is present between each movable contact 30 and the corresponding fixed contact 20, when said movable contact is in the uncoupled position O.

When the switching device 1 carries out a closing operation, each movable contact 30 moves from the uncoupled position O to the coupled position C. Such an operation of the switching device is directed to ensure electric continuity of the electric poles 10 and allow currents to flow along said electric poles.

According to some embodiments of the invention (FIGS. 4A-4, 6A-6, 7A-7A), each movable contact 30 reversibly moves between its coupled position C and its uncoupled position O by carrying out suitable opposite rotational movements.

According to other embodiments of the invention (FIGS. 5A-5B), each movable contact 30 reversibly moves between the coupled position C and the uncoupled position O by carrying out suitable opposite linear movements.

According to some embodiments of the invention, the switching device 1 may comprise an arc chamber (not shown) having an internal volume, in which the fixed contact 20 and the movable contact 30.

According to some embodiments of the invention, the switching device 1 comprises, for each electric pole, also an arc-quenching arrangement 70 including a plurality of shaped arc-quenching plates 70B. Preferably, the arc-quenching arrangement 70 is located inside an arc chamber, proximally to the fixed contact 20 and the movable contact 30.

In general, the electric contacts 20 and 30, any possible arc-quenching arrangements 70 and/or any possible arc chambers of the switching device may be realized according to solutions of known type and they will described hereinafter in relation to the aspects of interest of the invention only, for the sake of brevity.

The switching device 1 may further comprise a variety of other components (most of them are not shown in the cited figures), which may be realized according to solutions of known type. Also, these additional components will be not described hereinafter, for the sake of brevity.

An important distinguishing feature of the present invention consists in that the switching device 1 comprises, for each electric pole 10, at least an arc-diverting element 50.

Each arc-diverting element 50 is conveniently made of electrically insulating material, e.g. a plastic material.

Preferably, the arc-diverting element 50 is made of a degassing material, for example PTFE.

Figure 2B:
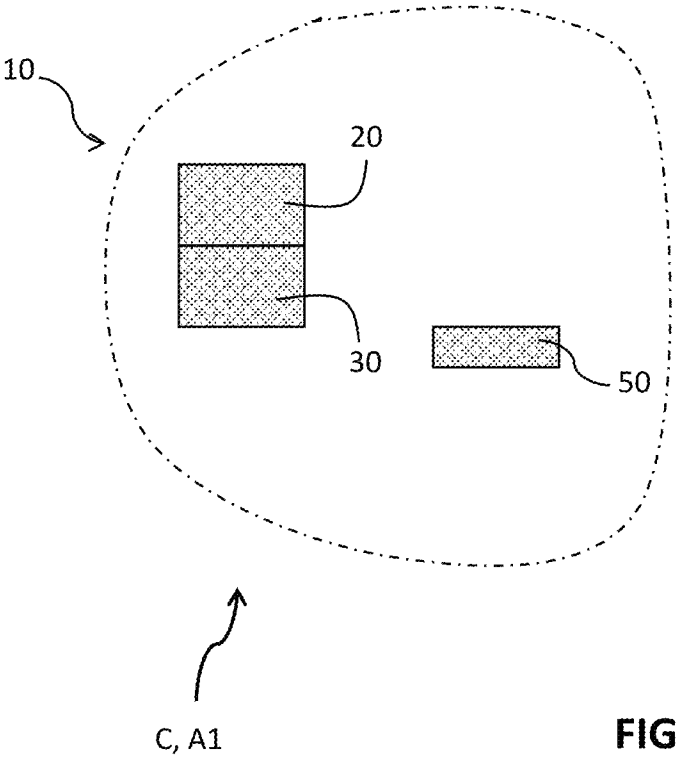
FIGS. 2A-3D schematically show the general operation of switching device according to the invention.
Figure 2A:
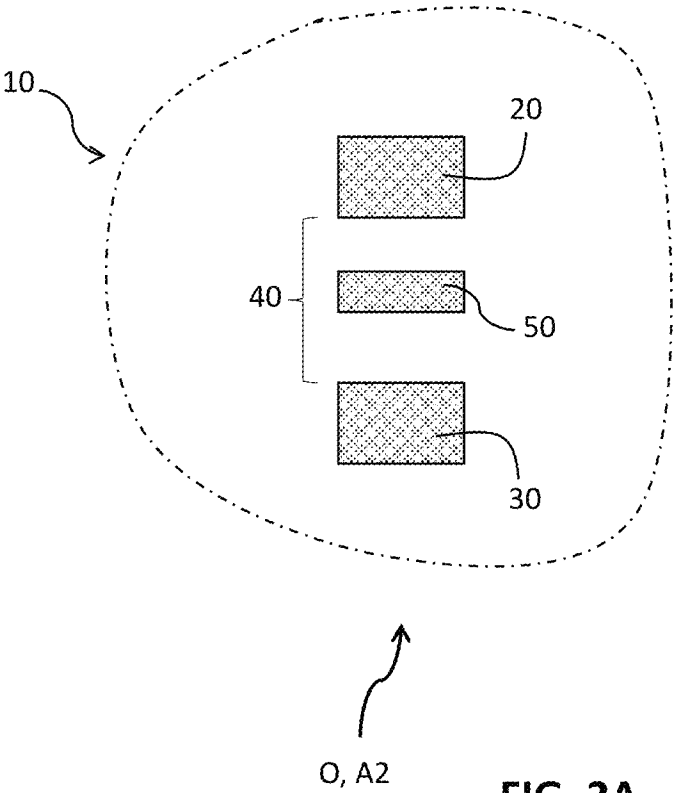

Each arc-diverting element 50 is switchable between an inactive position A1 (FIG. 2B), at which it is not interposed between a corresponding movable contact 30 and a corresponding fixed contact 20, and an active position A2, in which it is at least partially interposed between the corresponding movable contact 30 and the corresponding fixed contact 20, at the separation gap 40 between the electric contacts 20 and 30 (FIG. 2A).

According to the invention, each arc-diverting element 50 switches from the inactive position A1 to the active position A2 upon a movement of the corresponding movable contact 30 from the coupled position C to the uncoupled position O.

According to some embodiments of the invention (FIGS. 4A-4D, 5A-5B, 6A-6D), each arc-diverting element 50 is arranged in such a way that its movement from the inactive position A1 to the active position A2 is caused by the movement of the corresponding movable contact 30 from the coupled position C to the uncoupled position O.

According to other embodiments of the invention (FIGS. 7A-7B), each arc-diverting element 50 is moved by a motion transmission mechanism operating upon the movement of the corresponding movable contact 30 from the coupled position C to the uncoupled position O.

According to the invention, each arc-diverting element 50 switches from the active position A2 to the inactive position A1 upon a movement of the corresponding movable contact 30 from the coupled position C to the uncoupled position O.

Preferably, the movement of each arc-diverting element 50 from the active position A2 to the inactive position A1 is caused by the corresponding movable contact 30, when this latter moves from the uncoupled position O to the coupled position C.

According to some embodiments of the invention (FIGS. 4A-4D, 5A-5B, 6A-6D), the movable contact 30 may drive the arc-diverting element 50 in a direct manner, i.e. by directly applying a force on the corresponding arc-diverting element 50.

According to some embodiments of the invention (FIGS. 7A-7B), the movable contact 30 may exert its driving action on the arc-diverting element 50 through actuating means or through a motion transmission mechanism.

According to some embodiments of the invention (FIGS. 4A-4D, 5A-5B, 7A-7B), the switching device 1 comprises, for each electric pole 10, multiple (preferably a pair) arc-diverting elements 50 operatively associated to each pair of electric contacts 20 and 30.

According to other embodiments of the invention (FIGS. 6A-6D), the switching device 1 comprises, for each electric pole 10, a single arc-diverting element 50 operatively associated to each pair of electric contacts 20 and 30.

FIGS. 3A-3D schematically show how an arc-diverting element 50 works during an opening operation of the switching device 1.

In the above-mentioned figures an electric pole 10 of the switching device 1 is schematically shown. For the sake of simplicity, the electric pole 10 is supposed to include only a fixed contact 20, a movable contact 30 and an arc-diverting element 50 operatively associated to the electric contacts 20 and 30.

Figure 3B:
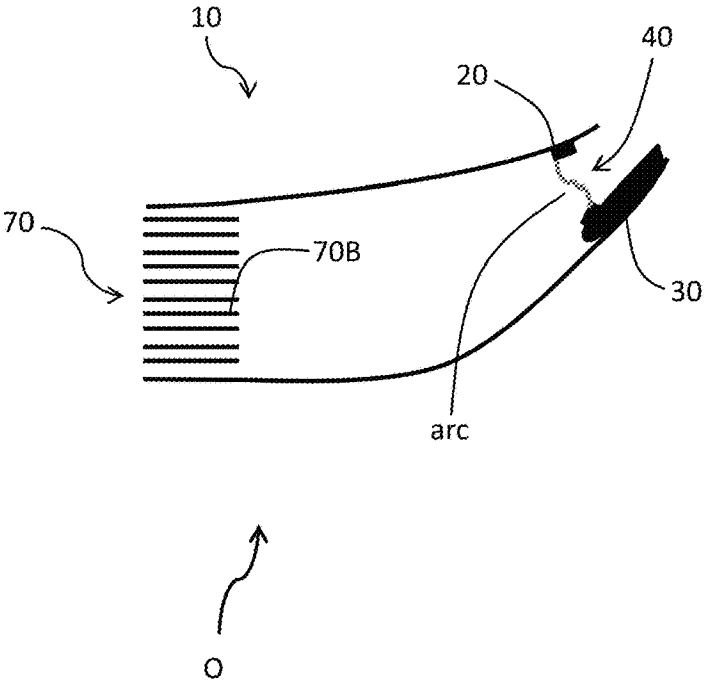
Figure 3A:
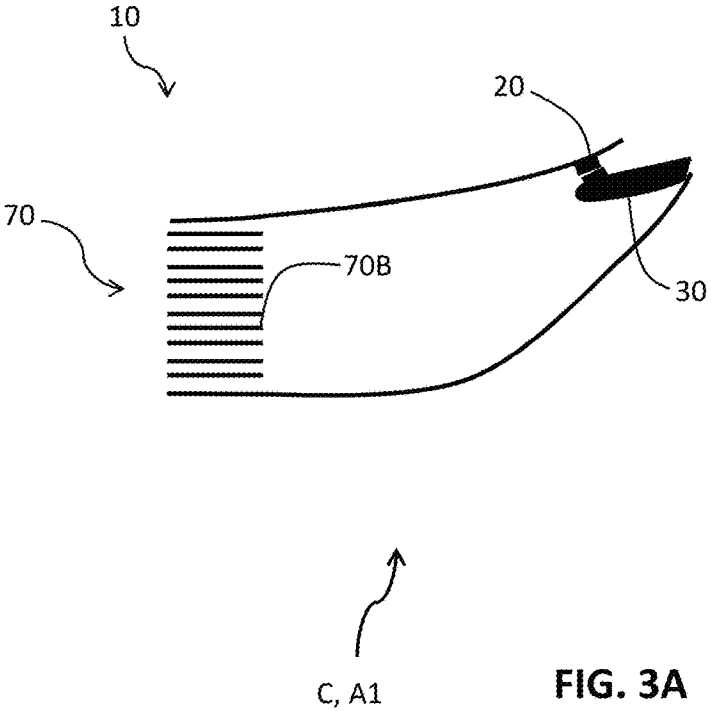
Figure 3D:
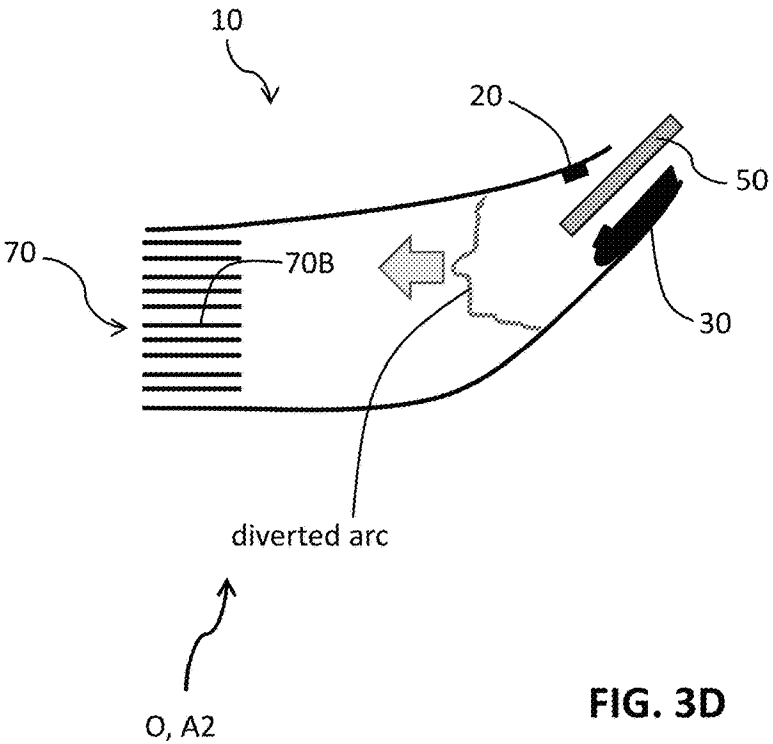

The movable contact 30 is initially supposed to be in the coupled position C with the corresponding fixed contact 20 (FIG. 3A). A current can therefore flow along the electric pole 10. In this situation, the corresponding arc-diverting element 50 (not shown in FIGS. 3A-3B) is in its inactive position A1 and it does not interact with the operation of the electric pole 10.

It is now supposed that the switching device 1 carries out an opening operation.

Such an operation may be carried out in fault conditions, i.e. with the aim of interrupting a fault current (e.g. an overload current or a short-circuit current having values very higher than a nominal value foreseen for the switching device) flowing along the electric pole 10.

However, such an operation may be also carried out in absence of fault conditions, i.e. with the aim of interrupting currents taking a nominal value of lower.

As mentioned above, electric arcs normally rise at the separation gap 40 between the electric contacts 20 and 30, when the switching device 1 carries out an opening operation and the movable contact 30 moves away from their coupled position C to reach the uncoupled position O (FIG. 3B).

If the opening operation is carried out in fault conditions, said electric arcs move away from the separation gap 40 between the electric contacts 20, 30 in a very short time (generally less than 1 ms). As mentioned above, this is basically due to the strong electromagnetic forces generated by the high currents circulating along the electric pole 10.

The same occurs when the opening operation is carried out in absence of fault conditions, when currents having an intensity around a nominal value flow along the electric poles.

Instead, if the opening operation is carried out in presence of so-called "critical currents", said electric arcs tend to station at the separation gap 40 between the electric contacts 20, 30 as the magnetic forces generated by the currents circulating along the electric pole 10 are not sufficiently strong to move these arcs away.

For the sake of clarity, it is specified that the term "critical currents" identifies currents having an intensity lower than the nominal value provided for the switching device but higher than a threshold value, which depends on the type of the switching device.

As an example, critical currents may take values comprised in a range between 5% and 30% of the nominal value or a similar range.

During an opening operation of the switching device, upon the movement of the movable contact 30 from the coupled position C to the uncoupled position O, the arc-diverting element 50 moves from the inactive position A1 to the active position A2. In this situation, the arc-diverting element 50 is interposed between the fixed contact 20 and the movable contact 30 at the separation gap 40, thereby partially obstructing this latter.

Being of electrically insulating material, the arc-diverting element 50 interferes with the conductive paths followed by possible electric arcs present at the separation gap 40 thereby perturbing the above-mentioned electric arcs.

Figure 3C:
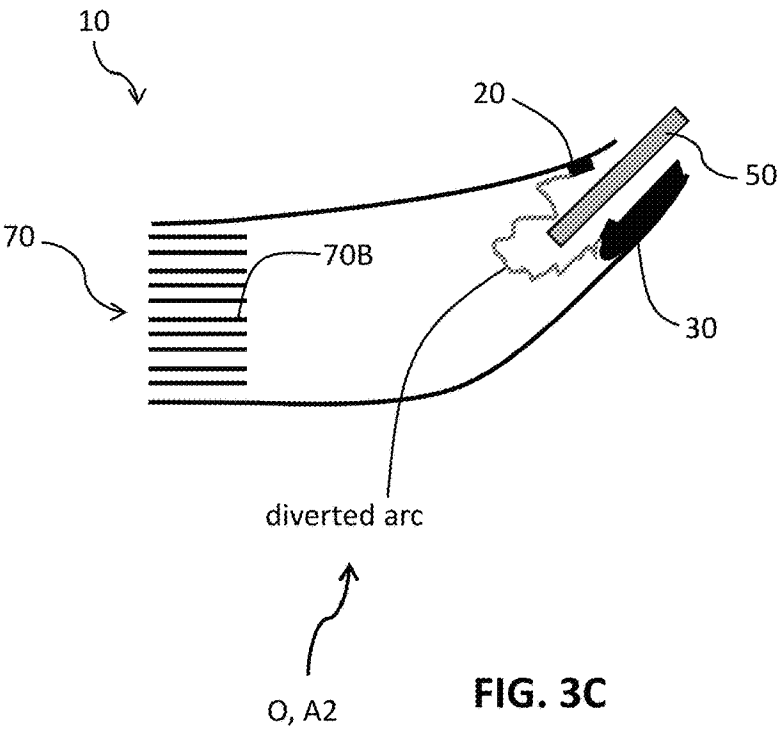

The arc-diverting element 50 may thus cause an increase of the length of said electric arcs, thereby reducing the circulating current and favoring the arc-quenching process (FIG. 3C). In addition, the arc-diverting element 50 may cause also a displacement of said electric arcs, which are thus moved away from the electric contacts 20 and 30 (FIG. 3D), e.g. towards a possible arc-quenching arrangement 70 operatively associated to the electric contacts 20 and 30.

In view of the above, it is apparent that the arc-diverting element 50 is particularly effective when the switching device 1 carries out an opening operation to interrupt critical currents flowing along the electric poles.

In this case, in fact, the probability of having electric arcs stationing at the region between the electric contacts 20 and 30 (separation gap 40) is quite higher and the arc-diverting element 50 can effectively perturb them, thus favoring their quenching.

It is evidenced that, in order to exert its arc-perturbing action, the arc-diverting element 50 does not need to form a partitioning wall through the arc chamber.

When it is in its active position A2, the arc-diverting element 50 needs to be positioned at the separation gap 40 only, without occupying any further space. This allows reducing the overall size of the electric pole 10 and it greatly simplifies the design of the arc-diverting element 50. According to preferred embodiments of the invention, the arc-diverting element 50 moves from the inactive position A1 to the active position A2 with a time delay with respect to the separation of the movable contact 30 from the fixed contact 30. More precisely, when moving from the inactive position A1 to said active position A2, the arc-diverting element 50 reaches the separation gap 40 at an instant having a time delay with respect to the instant in which the movable contact 30 uncouples from the fixed contact 20, during an opening operation of said switching device. Preferably, said minimum time delay is higher than 1 ms.

The above-mentioned time delay may be obtained by delaying the instant in which the arc-diverting element 50 starts moving with respect to the movable contact or by prolonging the time needed by the arc diverting element to reach the active position A2, for example by suitably selecting the material of arc-diverting element 50 or by arranging suitable actuating mean or mechanisms to move the arc-diverting element 50.

According to some possible solutions, the arc-diverting element 50 may be formed by a flexible piece of electrically insulating material bending with a suitably prolonged reaction time upon a movement of the movable contact 30 from the coupled position C to the uncoupled position O.

According to other possible solutions, the arc-diverting element 50 may be operatively coupled to suitable elastic means or a motion transmission mechanism capable of actuating said arc-diverting element with a suitably prolonged reaction time or capable of prolonging the time needed by said arc-diverting element to reach the active position A1.

Thanks to the above-mentioned solution, the arc-diverting element 50 reaches the active position A2 with a controlled time delay.

In this way, if the switching device 1 carries out an opening operation in fault or nominal conditions, the arc-diverting element 50 is not subject to possible high power electric arcs as these latter have already moved away from the separation gap 40 between the electric contacts 20 and 30 by the time the arc-diverting element 50 reaches its active position. This allows improving its reliability as possible damages caused by high power electric arcs are prevented. As a result, the advantages brought by the arc-diverting element 50 are remarkably prolonged in lifetime, thus increasing the overall reliability of the switching device.

In the following some possible embodiments of the invention will be briefly described.

EXAMPLE #1

FIGS. 4A-4D schematically show an electric pole 10 of a switching device 1 in an embodiment implementing a double-breaking functionality.

The electric pole 10 comprises a pair of fixed contacts 20 (in FIGS. 4A-4D only a fixed contact is shown for the sake of simplicity) and a pair of movable contacts 30.

The movable contacts 30 are arranged on a rotating contact shaft 30A in such a way to be moved with rotational movements.

Each pair of electric contacts 20, 30 is operatively associated to an arc-quenching arrangement 70 according to a solution of known type.

According to this embodiment of the invention, a pair of arc-diverting elements 50 is operatively associated to each pair of electric contacts 20 and 30.

The switching device 1 comprises, for each electric pole 10, a pair of lamina 500 made of electrically insulating material.

Each lamina 500 is conveniently arranged in a seat 70A of the arc-quenching arrangement 70, which is designed (for example with a U-shape) in such a way to allow the movable contact 30 to move in proximity of the arc-quenching plates 70B.

Each lamina 500 comprises a fixing portion 501 fixed (e.g. by gluing) to a supporting surface 72 in this case a surface of the seat 70.

Each lamina 500 comprises a flexible portion 50 that is preferably pre-bent with respect to said fixed portion in rest conditions.

As it will be apparent from the following, the flexible portion 50 of each lamina 500 forms an arc-diverting element, in accordance to the present invention.

The flexible portion 50 of each lamina 500 may take an inactive position A1, in which it is not interposed between the movable contact 30 and the fixed contact 20.

Figure 4B:
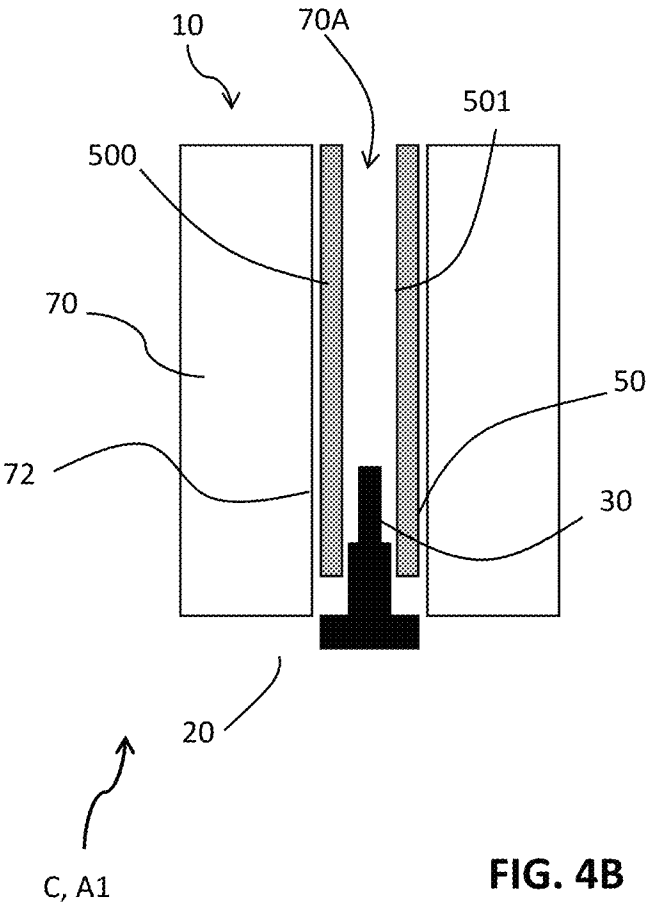
FIGS. 4A-4D schematically show a possible embodiment of a switching device according to the invention.
Figure 4A:
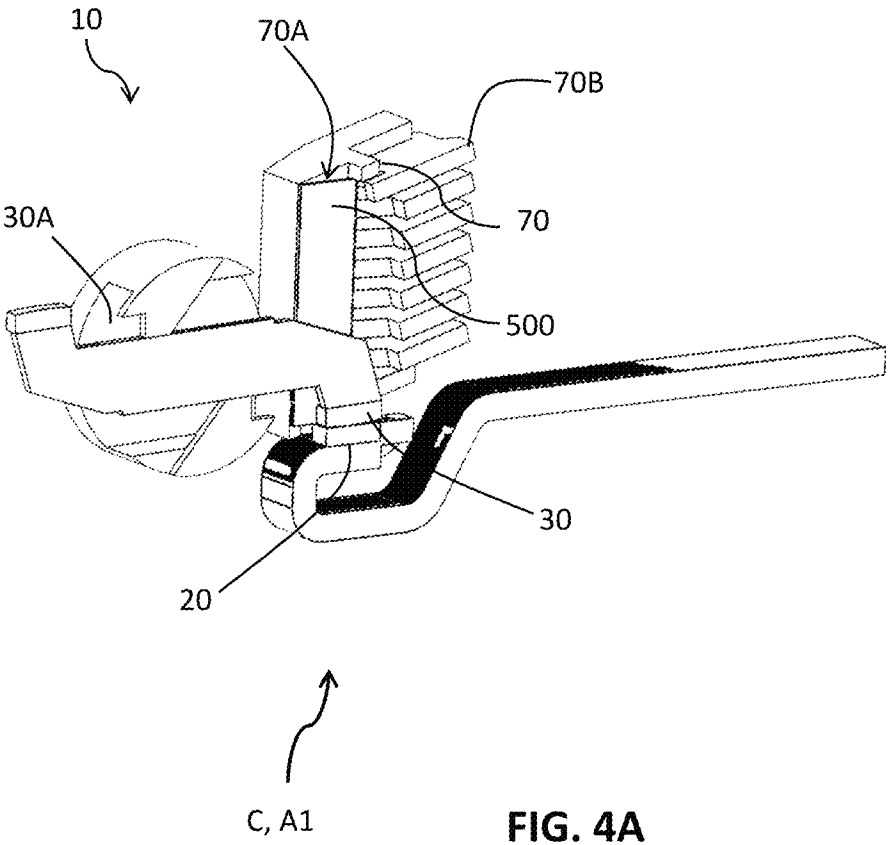

When it is in the inactive position A1, the flexible portion 50 of each lamina 500 is not bent with respect to the fixing portion 501 and it stores a certain amount of elastic energy (FIGS. 4A and 4B).

The flexible portion 50 of each lamina 500 is coupled with the movable contact 30 and it is kept in the inactive position A1 by this latter, when it is in the coupled position C.

Figure 4D:
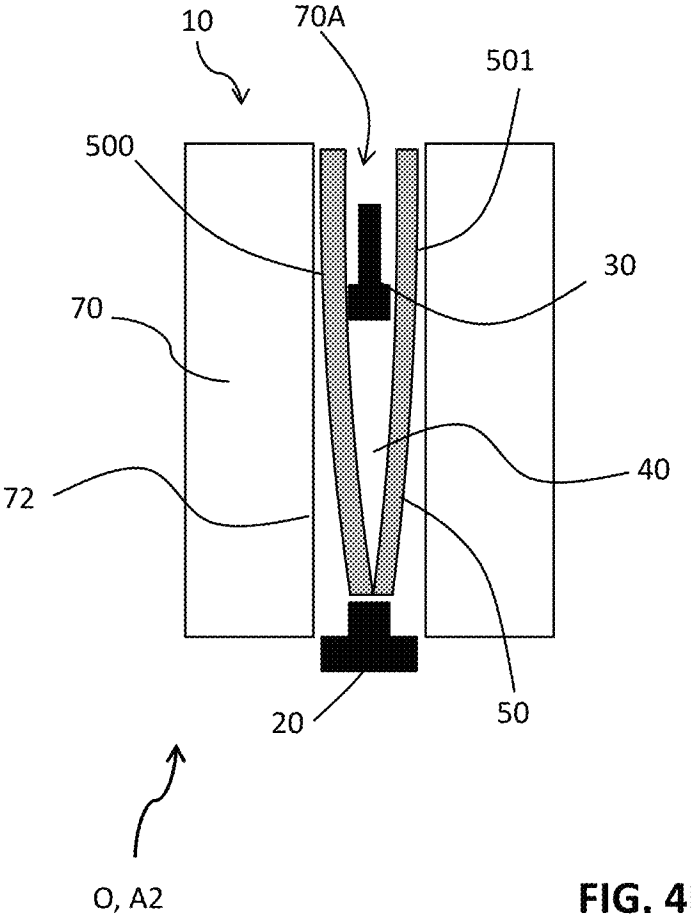
Figure 4C:
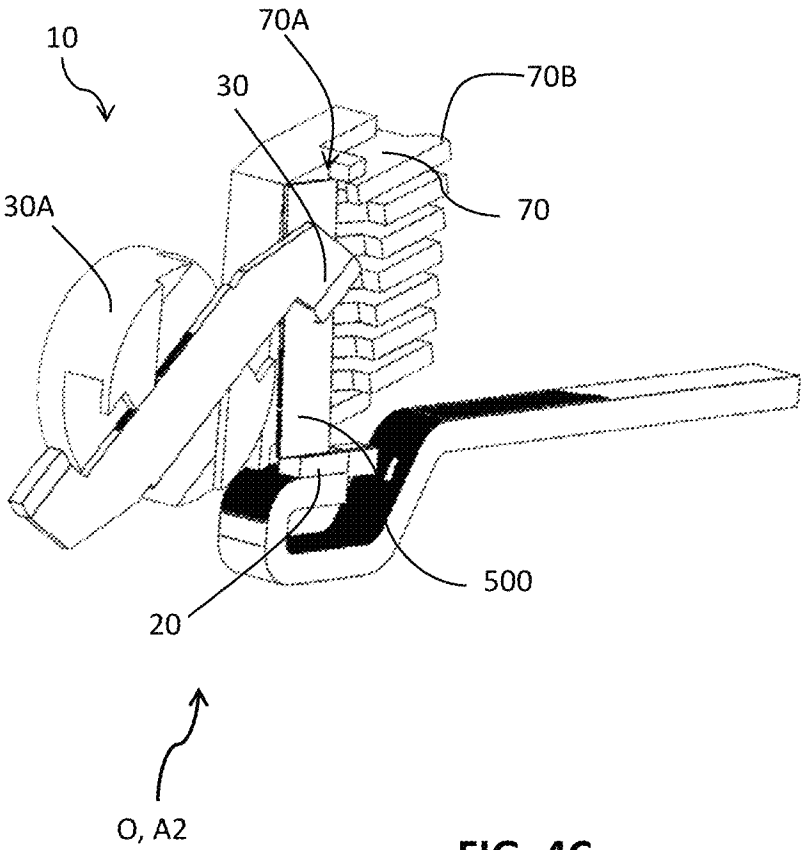

The flexible portion 50 of each lamina 500 may take an active position A2, in which it is interposed between the movable contact 30 and the fixed contact 20 at the separation gap 40 (FIGS. 4C and 4D).

The flexible portion 50 of each lamina 500 is movable between the inactive position A1 to the active position A2 upon a movement of the movable contact 30 from the coupled position C to the uncoupled position O.

When the movable contact 30 moves from the coupled position C to the uncoupled position O, the flexible portion 50 of the lamina 500 uncouples from the movable contact 30 and it is free to naturally bend with respect the fixed portion 501, thereby taking a released condition and moving into the separation gap 40.

Preferably, the material of the flexible portion 50 and/or its pre-bent shape and/or its coupling with the movable contact 30 are designed in such a way that the flexible portion 50 moves with a minimum time delay with respect to the movable contact 30 during an opening operation of the switching device.

The flexible portion 50 of the lamina 50 is movable from the active position A2 to the inactive position A1 upon a movement of the movable contact 30 from the coupled position C to the uncoupled position O.

When it returns in the coupled position C, the movable contact 30 pushes the flexible portion 50 of the lamina 500 away from the separation gap 40

According to possible variants of this embodiment of the invention, the switching device 1 might comprise, for each electric pole 10, a different number of lamina 500 made of electrically insulating material, e.g. a single lamina 500.

For the sake of completeness, it is evidenced that if the opening operation is carried out in fault or nominal conditions, the gas pressure generated by possible high power electric arcs will maintain the flexible portion 50 of each lamina 500 in the inactive position A1 until said electric arcs are extinguished. This will conveniently prolong the time delay with which each flexible portion 50 bends in relation to the movement of the movable contact 30.

EXAMPLE #2

Figure 5B:
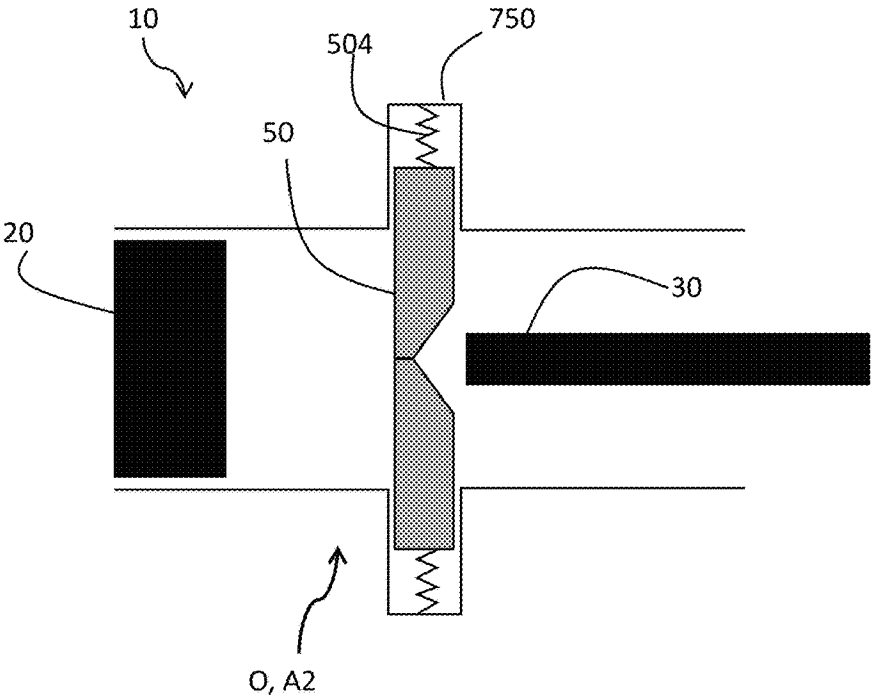
FIGS. 5A-5B schematically show another possible embodiment of a switching device according to the invention.
Figure 5A:
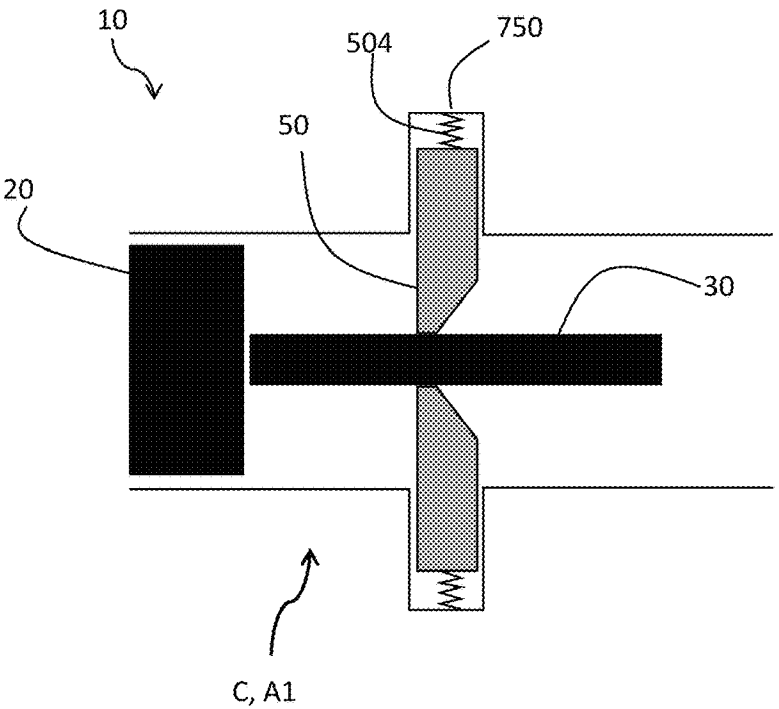

FIGS. 5A-5B schematically show an electric pole 10 of a switching device 1 in an embodiment implementing a single-breaking functionality.

The electric pole 10 comprises a fixed contact 20 and a movable contact 30. This latter can couple with or uncouple from the fixed contact 20 with suitable linear movements.

According to this embodiment of the invention, a pair of arc-diverting elements 50 is operatively associated to the electric contacts 20 and 30.

The switching device 1 comprises, for each electric pole 10, a pair of shaped plungers 50 of electrically insulating material, which are preferably aligned along a same reference plane of motion (not shown).

Each plunger 50 forms an arc-diverting element in accordance to the present invention.

Each plunger 50 is operatively coupled to a fixed support 750 by elastic means 504, for example a spring.

Each plunger 50 may take an inactive position A1, in which it is not interposed between the movable contact 30 and the fixed contact 20 (FIG. 5A).

When a plunger 50 is in the inactive position A1, the corresponding elastic means 504 coupled to it are conveniently compressed and they store a certain amount of elastic energy.

Each plunger 50 is coupled with the movable contact 30 and it is kept in the inactive position A1 by this latter, when it is in the coupled position C.

Each plunger 50 may take an active position A2, in which it is interposed between the movable contact 30 and the fixed contact 20 at the separation gap 40 (FIG. 5B).

When a plunger 50 is in the active position A2, the corresponding elastic means 504 coupled to it are in a released condition.

Preferably, the shape of each plunger 50 may be selected in such a way to form a continuous barrier transversal to the separation gap. As an example, when a pair of plungers 50 is used, said plungers may have complementary shapes (e.g. trapezoidal) to form the above-mentioned transversal barrier as shown in FIGS. 5A-5B.

Each plunger 50 is movable between the inactive position A1 to the active position A2 upon a movement of the movable contact 30 from the coupled position C to the uncoupled position O. When the movable contact 30 moves from the coupled position C to the uncoupled position O, each plunger 50 uncouples from it and it is moved by the corresponding elastic means 504 into the separation gap 40.

Preferably, the elastic means 504 and/or the coupling of the plunger 50 with the movable contact 30 are designed in such a way that the plunger 50 moves with a minimum time delay with respect to the movable contact 30 during an opening operation of the switching device.

Each plunger 50 is movable from the active position A2 to the inactive position A1 upon a movement of the movable contact 30 from the uncoupled position O to the coupled position C. When it returns in the coupled position C, the movable contact 30 exerts a force on an inclined contact surface of the plunger 50 and it pushes the plunger 50 away from the separation gap 40, thereby causing the compression of the corresponding elastic means 504.

According to possible variants of this embodiment of the invention, the switching device 1 might comprise, for each electric pole 10, a different number of plungers 50 made of electrically insulating material, e.g. a single plunger 50.

In the above-illustrated embodiment of the invention, each plunger 50 reversibly moves between the inactive position A1 and the active position A2 with suitable opposite linear movements. According to possible variants, each plunger 50 may however move with suitable opposite rotational movements.

EXAMPLE #3

FIGS. 6A-6D schematically show an electric pole 10 of a switching device 1 in another embodiment implementing a single-breaking functionality.

The electric pole 10 comprises a fixed contact 20 and a movable contact 30. This latter can couple with or uncouple from the fixed contact 20 with suitable rotational movements.

According to this embodiment of the invention, an arc-diverting element 50 is operatively associated to the electric contacts 20 and 30.

The switching device 1 comprises, for each electric pole 10, a shaped plunger 50 of electrically insulating material.

The plunger 50 forms an arc-diverting element in accordance to the present invention.

The plunger 50 is operatively coupled to a fixed support 750 by elastic means 504, for example a spring.

Figure 6B:
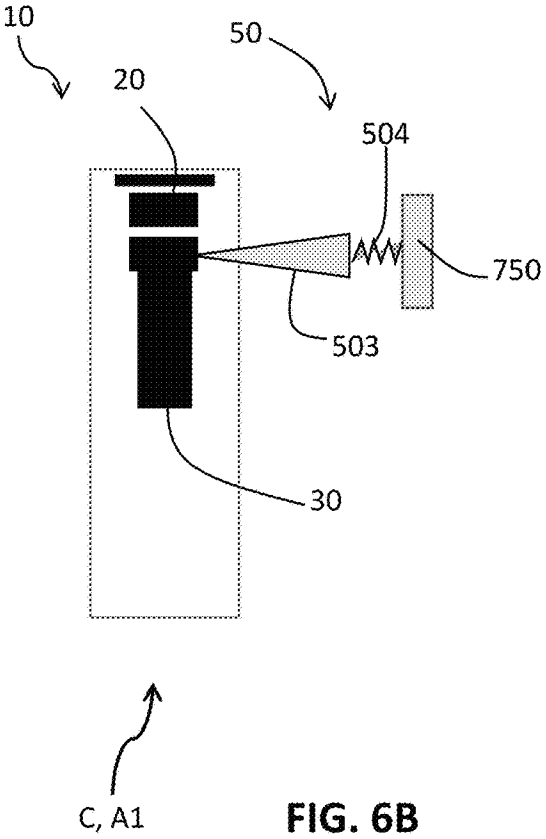
FIGS. 6A-6D schematically show another possible embodiment of a switching device according to the invention.
Figure 6A:
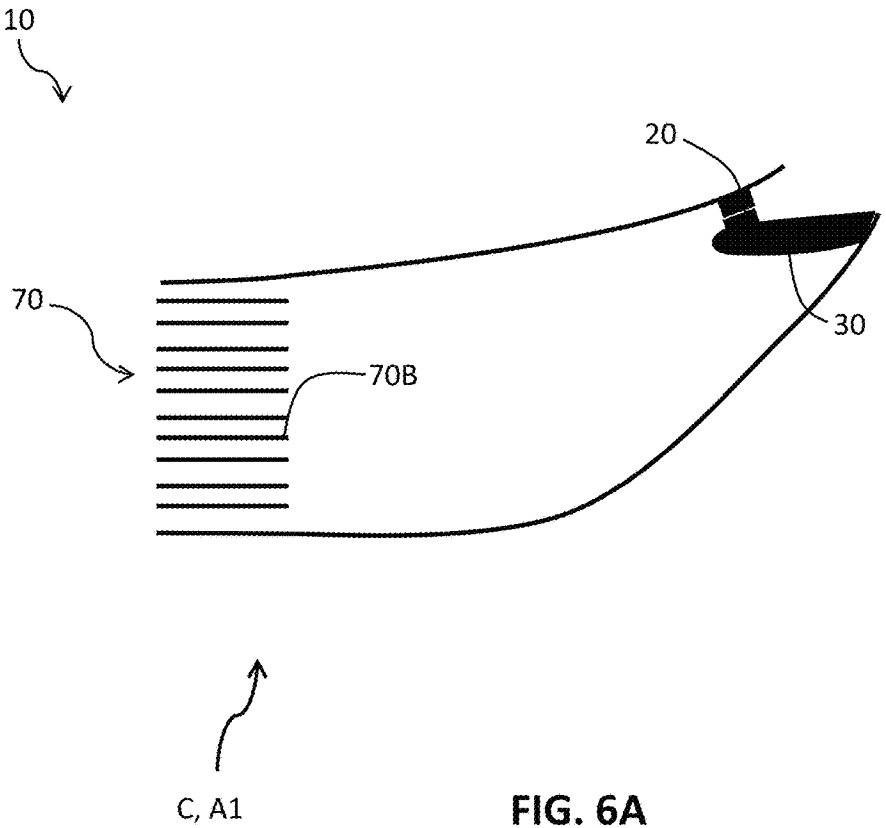

The plunger 50 may take an inactive position A1, in which it is not interposed between the movable contact 30 and the fixed contact 20 (FIG. 6B).

When the plunger 50 is in the inactive position A1, the elastic means 504 coupled to it are conveniently compressed thereby storing a certain amount of elastic energy.

The plunger 50 is coupled with the movable contact 30 and it is kept in the inactive position A1 by this latter, when it is in the coupled position C.

Figure 6D:
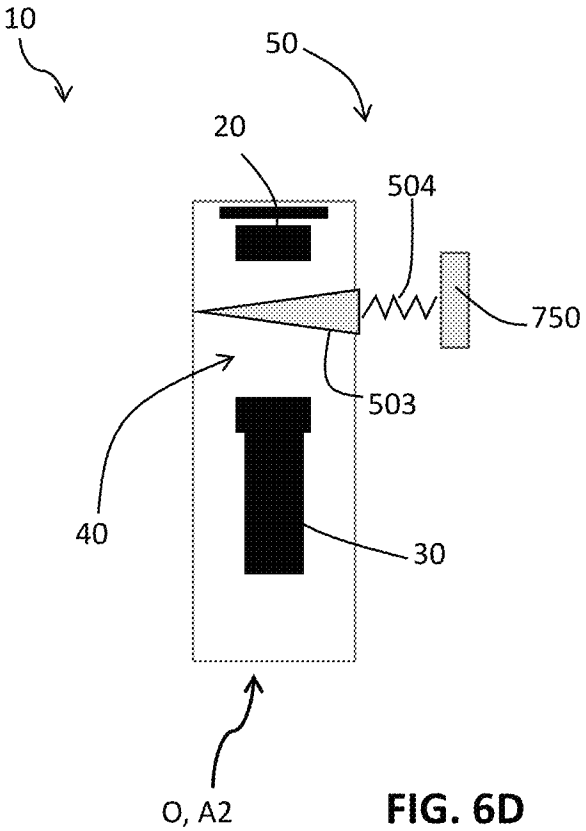
Figure 6C:
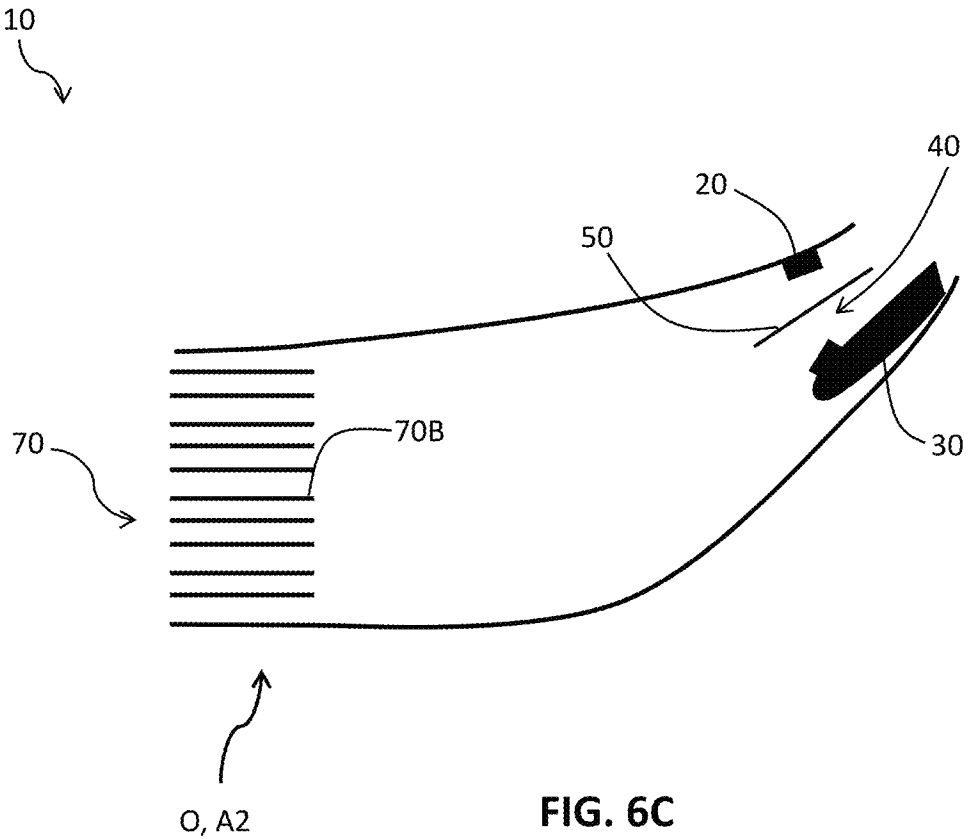

The plunger 50 may take an active position A2, in which it is interposed between the movable contact 30 and the fixed contact 20 at the separation gap 40 (FIGS. 6C and 6D).

When the plunger 50 is in the active position A2, the elastic means 504 coupled to it are in a released condition.

The plunger 50 is movable between the inactive position A1 to the active position A2 upon a movement of the movable contact 30 from the coupled position C to the uncoupled position O.

When the movable contact 30 moves from the coupled position C to the uncoupled position O, each plunger 50 uncouples from it and it is moved by the corresponding elastic means 504 into the separation gap 40.

Preferably, the elastic means 504 and/or the coupling of the plunger 50 with the movable contact 30 are designed in such a way that the plunger 50 moves with a minimum time delay with respect to the movable contact 30 during an opening operation of the switching device.

The plunger 50 is movable from the active position A2 to the inactive position A1 upon a movement of the movable contact 30 from the uncoupled position O to the coupled position C.

When it returns in the coupled position C, the movable contact 30 exerts a force on an inclined contact surface of the plunger 50 and it pushes the plunger 50 away from the separation gap 40, thereby causing the compression of the elastic means 504.

According to possible variants of this embodiment of the invention, the switching device 1 might comprise, for each electric pole 10, a different number of plungers 50 made of electrically insulating material, e.g. a pair of plungers 50 arranged as shown in FIGS. 5A-5B.

In the above-illustrated embodiment of the invention, the plunger 50 reversibly moves between the inactive position A1 and the active position A2 with suitable opposite linear movements.

According to possible variants, the plunger 50 may however move with suitable opposite rotational movements.

EXAMPLE #4

Figure 7B:
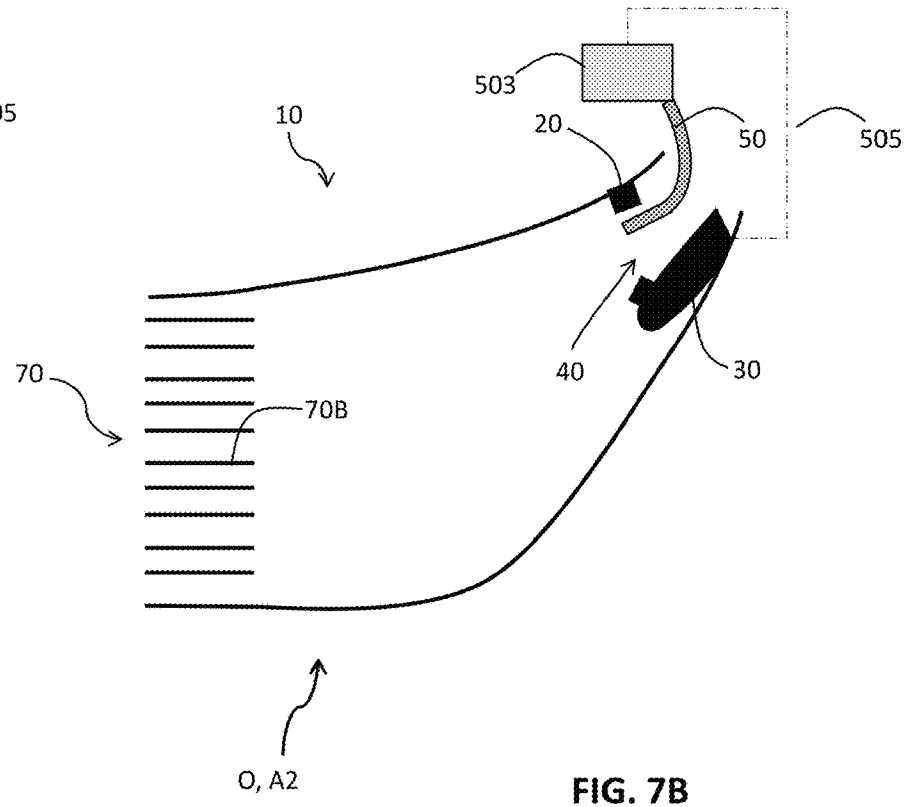
FIGS. 7A-7B schematically show another possible embodiment of a switching device according to the invention.
Figure 7A:
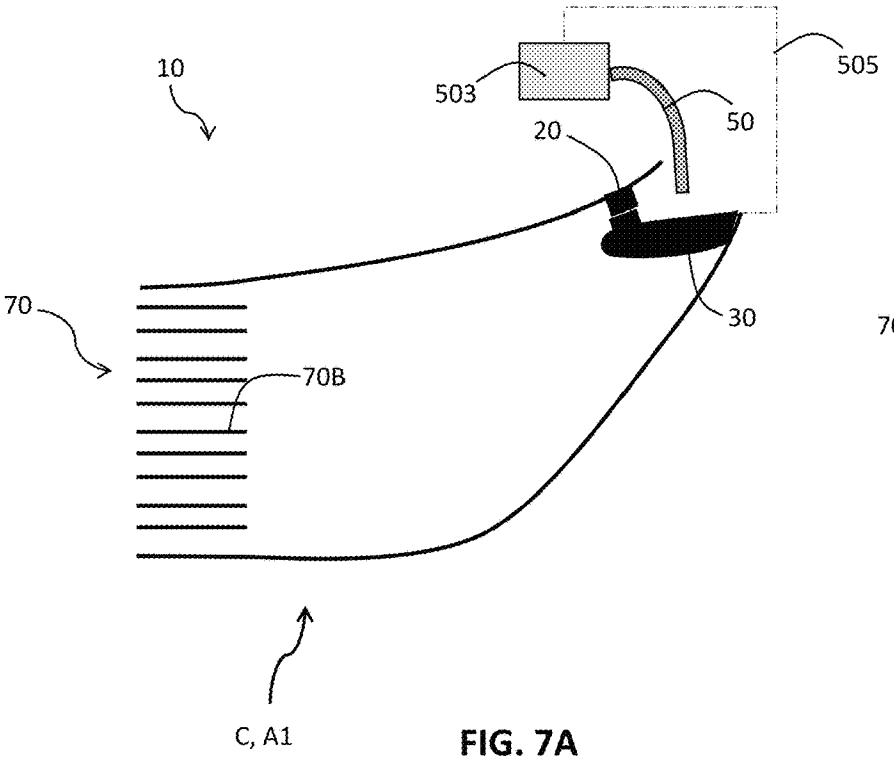

FIGS. 7A-7B schematically show an electric pole 10 of a switching device 1 in another embodiment implementing a single-breaking functionality.

The electric pole 10 comprises a fixed contact 20 and a movable contact 30. This latter can couple with or uncouple from the fixed contact 20 with suitable rotational movements.

According to this embodiment of the invention, an arc-diverting element 50 is operatively associated to the electric contacts 20 and 30.

The switching device 1 comprises, for each electric pole 10, a shaped plunger 50 of electrically insulating material.

The plunger 50 (e. g. having a curved shape) forms an arc-diverting element in accordance to the present invention.

The plunger 50 is operatively coupled to a motion transmission mechanism 503. In turn, this latter is operatively coupled to the movable contact 30 by a suitable kinematic chain 505. In this way, the movable contact 30 can actuate the actuating mechanism 503 and, consequently, the plunger 50.

The plunger 50 may take an inactive position A1, in which it is not interposed between the movable contact 30 and the fixed contact 20 (FIG. 7A).

The plunger 50 is kept in the inactive position A1 by the movable contact 30 in the coupled position C through the motion transmission mechanism 503.

The plunger 50 may take an active position A2, in which it is interposed between the movable contact 30 and the fixed contact 20 at the separation gap 40 (FIG. 7B).

The plunger 50 is movable between the inactive position A1 to the active position A2 upon a movement of the movable contact 30 from the coupled position C to the uncoupled position O. When the movable contact 30 moves from the coupled position C to the uncoupled position O, the motion transmission mechanism 503 is commanded to move the plunger 50 in the active position A2.

Preferably, the motion transmission mechanism 503 is designed in such a way that the plunger 50 moves with a minimum time delay with respect to the movable contact 30 during an opening operation of the switching device.

The plunger 50 is movable from the active position A2 to the inactive position A1 upon a movement of the movable contact 30 from the uncoupled position O to the coupled position C.

When it returns in the coupled position C, the movable contact 30 commands the motion transmission mechanism 503 to move the plunger 50 in the inactive position A1.

According to possible variants of this embodiment of the invention, the switching device 1 might comprise, for each electric pole 10, a different number of plungers 50 made of electrically insulating material, e.g. a pair of plungers 50.

In the above-illustrated embodiment of the invention, the plunger 50 reversibly moves between the inactive position A1 and the active position A2 with suitable opposite rotational movements. According to possible variants, the plunger 50 may however move with suitable opposite linear movements.

As the skilled person might easily understand, several additional variants of the above-described embodiments are possible depending on how the arc-diverting element 50 and its possible actuating means (elastic means and motion transmission mechanisms) are designed.

The switching device 1, according to the invention, fully achieves the intended aims/objects and solves the above-highlighted problems of the existing switching devices.

Thanks to the arrangement of one or more arc-diverting elements 50 made of electrically insulating material operatively associated with the electric contacts 20, 30 of the electric poles 10, the switching device 1 shows improved arc-quenching capabilities.

In particular, the switching device 1 results particularly effective in extinguishing possible electric arcs rising between the electric contacts 20, 30 of the electric poles 10 when critical currents are interrupted during an opening operation.

The switching device 1 is particularly adapted for use in DC applications, as the one or more arc-diverting elements 50 can effectively prevent possible electric arcs (generated by the interruption of relatively low DC currents, in particular critical currents) from stationing for a relatively long time at the separation gap 40 between the electric contacts.

However, the switching device 1 may be conveniently used also in AC applications. In this case, the switching device conveniently shows a reduced commutation time (for relatively low currents, in particular critical currents) as the one or more arc-diverting elements 50 effectively contribute to quench possible electric arcs at the separation gap 40 between the electric contacts 20 and 30. The switching device 1 is relatively easy and cheap to manufacture at industrial level with well-established manufacturing techniques. It may therefore be manufactured at competitive costs with similar switching devices of the state of the art.

The invention claimed is:

1. A switching device for low-voltage or medium-voltage applications comprising:

one or more electric poles;

for each electric pole, at least a fixed contact and at least a movable contact, each movable contact being reversibly movable between a coupled position, at which said movable contact is coupled with a corresponding fixed contact, and an uncoupled position, at which said movable contact is separated from said fixed contact, wherein a separation gap is present between said movable contact and said fixed contact, when said movable contact is in said uncoupled position; and for each electric pole, at least one arc-diverting element made of electrically insulating material, each arc-diverting element of the at least one arc-diverting element being biased towards a corresponding movable contact and switchable between an inactive position, at which said arc-diverting element is not interposed between said movable contact and a corresponding fixed contact, and an active position, in which at least a portion of said arc-diverting element is interposed between said movable contact and said fixed contact at the separation gap between said movable contact and said fixed contact, wherein said arc-diverting element switches from said inactive position to said active position when said movable contact moves from said coupled position to said uncoupled position, and wherein said arc-diverting element switches from said active position to said inactive position in response to a movement of said movable contact along a contact face of the at least a portion of said arc-diverting element when said movable contact moves from said uncoupled position to said coupled position, wherein the movement of said movable contact along said contact face displaces the at least a portion of said arc-diverting element out of the separation gap between said movable contact and said fixed contact.

2. The switching device, according to claim 1, wherein said arc-diverting element is driven by said movable contact, when moving from said active position to said inactive position.

3. The switching device, according to claim 2, wherein said arc-diverting element, when moving from said inactive position to said active position, reaches said separation gap with a time delay with respect to an instant in which said movable contact separates from said fixed contact.

4. The switching device, according to claim 3, wherein said time delay is higher than 1 ms.

5. The switching device, according to claim 4, wherein for each electric pole, at least a lamina of electrically insulating material, said lamina comprising a fixing portion fixed to a supporting surface and a flexible portion forming the arc-diverting element, wherein said flexible portion is movable between the inactive position, at which said flexible portion is not bent with respect to said fixing portion and is not interposed between said movable contact and said fixed contact, and the active position, in which said flexible portion is bent with respect to said fixing portion and is interposed between said movable contact and said fixed contact at the separation gap between said movable contact and said fixed contact.

6. The switching device, according to claim 4, wherein for each electric pole, at least a shaped plunger of electrically insulating material forms the arc-diverting element and an elastic coupler operatively couples said plunger to a fixed support, and wherein said plunger is reversibly movable between the inactive position, at which said plunger is not interposed between said movable contact and said fixed contact, and the active position, in which said plunger is interposed between said movable contact and said fixed contact at the separation gap between said movable contact and said fixed contact.

7. The switching device, according to claim 6, wherein said plunger is reversibly movable between said inactive position and said active position with opposite rotational movements.

8. The switching device, according to claim 6, wherein said plunger is reversibly movable between said inactive position and said active position with opposite linear movements.

9. The switching device, according to claim 4, wherein for each electric pole, at least a shaped plunger of electrically insulating material forms the arc-diverting element and an actuating mechanism actuates said plunger and operatively couples with said movable contact by a kinematic chain, and wherein said plunger is reversibly movable between the inactive position, at which said plunger is not interposed between said movable contact and said fixed contact, and the active position, in which said plunger is interposed between said movable contact and said fixed contact at the separation gap between said movable contact and said fixed contact.

10. The switching device, according to claim 9, wherein said plunger is reversibly movable between said inactive position and said active position with opposite rotational movements.

11. The switching device, according to claim 9, wherein said plunger is reversibly movable between said inactive position and said active position with opposite linear movements.

12. The switching device, according to claim 1, wherein said movable contact reversibly moves between said coupled position and said uncoupled position with opposite rotational movements.

13. The switching device, according to claim 1, wherein said movable contact reversibly moves between said coupled position and said uncoupled position with opposite linear movements.

14. The switching device, according to claim 1, wherein for each electric pole, an arc-quenching arrangement is operatively associated to said fixed contact and said movable contact, said arc-quenching arrangement including a plurality of shaped arc-quenching plates.

15. The switching device, according to claim 1, wherein said arc-diverting element is made of a degassing material.

16. A DC or AC electric system comprising the switching device, according to claim 1.

17. The switching device, according to claim 1, wherein said arc-diverting element, when moving from said inactive position to said active position, reaches said separation gap with a time delay with respect to an instant in which said movable contact separates from said fixed contact.

18. The switching device, according to claim 1, further comprising, for each electric pole, at least a lamina of electrically insulating material, said lamina comprising a fixing portion fixed to a supporting surface and a flexible portion forming the arc-diverting element, wherein said flexible portion is movable between the inactive position, at which said flexible portion is not bent with respect to said fixing portion and is not interposed between said movable contact and said fixed contact, and the active position, in which said flexible portion is bent with respect to said fixing portion and is interposed between said movable contact and said fixed contact at the separation gap between said movable contact and said fixed contact.

19. The switching device, according to claim 1, wherein for each electric pole, at least a shaped plunger of electrically insulating material forms the arc-diverting element and an elastic coupler operatively couples said plunger to a fixed support, wherein said plunger is reversibly movable between the inactive position, at which said plunger is not interposed between said movable contact and said fixed contact, and the active position, in which said plunger is interposed between said movable contact and said fixed contact at the separation gap between said movable contact and said fixed contact.

20. The switching device, according to claim 1, wherein for each electric pole, at least a shaped plunger of electrically insulating material forms the arc-diverting element and an actuating mechanism actuates said plunger and operatively couples with said movable contact by a kinematic chain, and wherein said plunger is reversibly movable between the inactive position, at which said plunger is not interposed between said movable contact and said fixed contact, and the active position, in which said plunger is interposed between said movable contact and said fixed contact at the separation gap between said movable contact and said fixed contact.

* * * * *